US005417030A

United States Patent [19]

Ribani et al.

[11] Patent Number: 5,417,030

[45] Date of Patent: May 23, 1995

[54] DEVICE FOR ORIENTATING THE BASES AND CAPS OF HARD GELATIN CAPSULES

[75] Inventors: Angiolino Ribani; Aristide Cané; Nerio Mirri; Marco Marescalchi, all of Bologna, Italy

[73] Assignee: I.M.A. Industria Macchine Automatiche SpA, Bologna, Italy

[21] Appl. No.: 193,453

[22] Filed: Feb. 8, 1994

[30] Foreign Application Priority Data

Feb. 16, 1993 [IT] Italy ..... BO93A 000043

[51] Int. Cl.[6] ..... B65B 5/00

[52] U.S. Cl. ..... 53/281; 53/900; 53/367

[58] Field of Search ..... 53/281, 282, 283, 291, 53/292, 544, 900, 143, 367

[56] References Cited

U.S. PATENT DOCUMENTS 3,527,015 9/1970 Aronson et al. ..... 53/282

4,089,152 5/1978 Zanasi ..... 53/281

*Primary Examiner*—John Sipos

*Assistant Examiner*—Gene L. Kim

*Attorney, Agent, or Firm*—Larson and Taylor

[57] ABSTRACT

The bases and caps are aligned in two stages, with displacement by first pointed pushers (13–31) into corresponding calibrated horizontal channels (12–29) followed by displacement by second pushers (21–44) into corresponding calibrated vertical and descending channels (312–329). The second pusher (21) pushes the bases horizontally into the wider terminal part (20) of the descending channel, where the base is sucked by its sealed end and inserted into the corresponding supporting socket (1), with a vertical disposition and with the opening upwards. The second pusher (44), operating with the caps, acts on the intermediate parts of these with a point (144) which causes the caps to rotate with the opening downwards and transfers them with a vertical disposition into the wider terminal part (42) of the descending channel where the cap is held by a suction tube (46) which inserts it into the corresponding supporting socket (2). The seats (28) to which the caps are fed for orientation are provided at their bases with supports (37–137 or 39–139) which ensure that the caps are stopped at different levels and that they have the best disposition with respect to the first orientating pusher.

13 Claims, 4 Drawing Sheets

DEVICE FOR ORIENTATING THE BASES AND CAPS OF HARD GELATIN CAPSULES

BACKGROUND AND SUMMMARY OF THE INVENTION

The invention relates to a device for orientating the bases and caps of hard gelatin capsules and for feeding these initially separate enclosing elements to a machine for pre-sealing or for filling and sealing the capsules. The device according to the invention can be used with hard gelatin capsules of conventional construction or with capsules of special construction and/or shape, for example those of the SCHERER type.

The device according to the invention is intended to solve a problem which is new in the field of capsules for medicinal use, consisting in the fact that the caps and bases of the capsules are initially separated from each other and are kept loose in corresponding magazines, since the two enclosing elements of the capsules, especially in the case of the aforesaid special capsules, undergo different operations, in the process of their manufacture, such that the said enclosing elements cannot be advantageously pre-assembled using the conventional methods.

The device according to the invention may therefore be used by the manufacturers of special capsules, to enable them to supply the capsules in pre-sealed form to those industries which will carry out the filling of the said capsules with conventional methods and machines, or may be used in combination with a machine for filling and sealing the capsules, in which the bases and caps of the capsules are fed loose in corresponding magazines. In both the first and the second case, the device will orientate the bases of the capsules with the opening facing upwards and will insert each base into a supporting socket, while the caps will be orientated with the opening downwards and will be inserted into a corresponding supporting socket. The sockets containing the caps are located at a higher level than those containing the bases and are preferably disposed with their axes vertical. The sockets containing the bases and the caps are carried by horizontally movable means by means of which the said sockets may be moved out of alignment with each other to permit the operation of the means of feeding the two separate parts of the capsule to the sockets and/or to permit the insertion of doses of a medicinal product and of any plugs or diaphragms into the bases for any known use, or may be aligned axially with each other to enable the base to be fed to the lower socket, with the empty upper socket into which the cap is subsequently to be inserted passing across it, and/or to initiate the final phase of sealing the capsule, with the raising of the empty or full base, the insertion of the base into the cap which is located above it and is temporarily retained by a suitable check piece and with the final raising and lateral expulsion of the sealed capsule.

One object of the present invention is to provide a device for orientating and feeding the bases and caps of the capsules which is of simplified construction and high technological reliability, and may be combined with a high-output enclosing machine of the carousel type.

According to the invention, the bases and caps are fed one at a time to a corresponding vertical seat which contains them with a certain amount of play, and in which they may be orientated with the opening upwards or downwards. This seat is disposed in the intermediate part of a horizontal channel, the section of which up-line from the said seat is engaged slidably by an orientating pusher with a point facing the aforesaid seat. The section of the said horizontal channel disposed down-line from the seat has a width slightly less than that of the outer area of greater width of the cap or base, so that, when the said pusher operates and its point acts on the intermediate part of the base or cap, the rounded end of the component, which has a greater resistance to crushing, encounters a greater sliding friction in the channel, so that, under the action of the point of the pusher, the base or cap of the capsule is orientated with the opening forward and in this condition reaches the terminal part of the orientation channel, with a substantially horizontal disposition. This channel follows a second vertical and ascending channel, whose width is equal to that of the first channel and which terminates in a suitably wider lower section. While the initial orientation pusher withdraws to repeat the cycle, a second pusher comes into operation and, in the case of the base, acts on it with a flat and horizontal or suitably inclined end, so that the base reaches the wider terminal part of the ascending channel where it is picked up by suction by its rounded end and inserted into the corresponding supporting socket, with a vertical disposition and with the opening upwards. The second pusher, which acts on the caps, is instead provided with a point which acts on the intermediate part of the said cap and causes its open end to rotate downwards. The cap reaches the wider terminal part of the second channel with a vertical disposition and with its opening downwards, and from here it is picked up by suitable suction means and inserted by them into the supporting socket lying below.

A further object of the invention is to provide the part of the device which orientates the caps with means which stop the cap at different levels in the first seat of the device, according to the orientation in which the cap reaches the said seat, so that the cap is always correctly disposed with respect to the point of the initial orientation pusher. A further object is to make the said cap stop means adjustable so that it is possible to operate correctly with capsules which are of the same format but may differ slightly in their geometry and/or dimensions.

BRIEF DESCRIPTION OF THE DRAWINGS

The characteristics of the device according to the invention, and the advantages derived therefrom, will be clear from the following description of a preferred embodiment of the invention, illustrated purely by way of non-restrictive example in the figures on the four attached sheets of drawings, in which.

DESCRIPTION OF THE PREFERRED EMBODIMENT OF THE INVENTION

Figure 2:
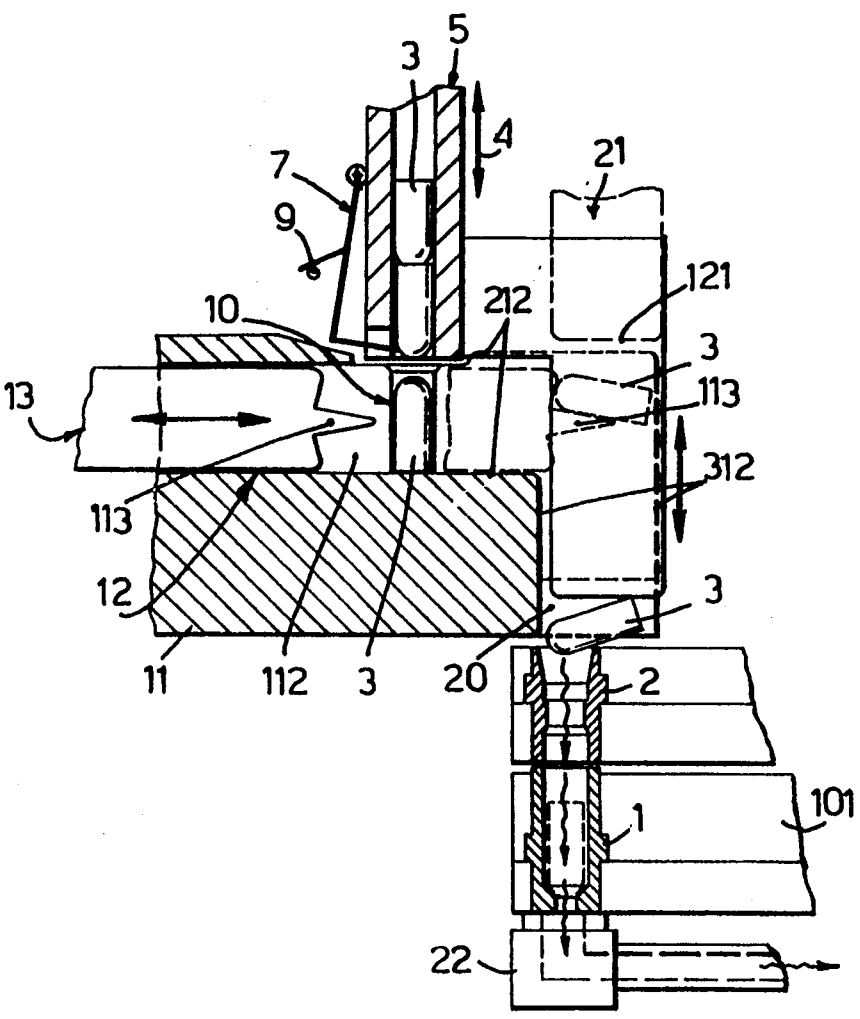
FIGS. 1 and 2 are side views and partial sections of the components of the device for orientating and feeding the bases of the capsules, shown in different operating conditions in each figure.
Figure 1:
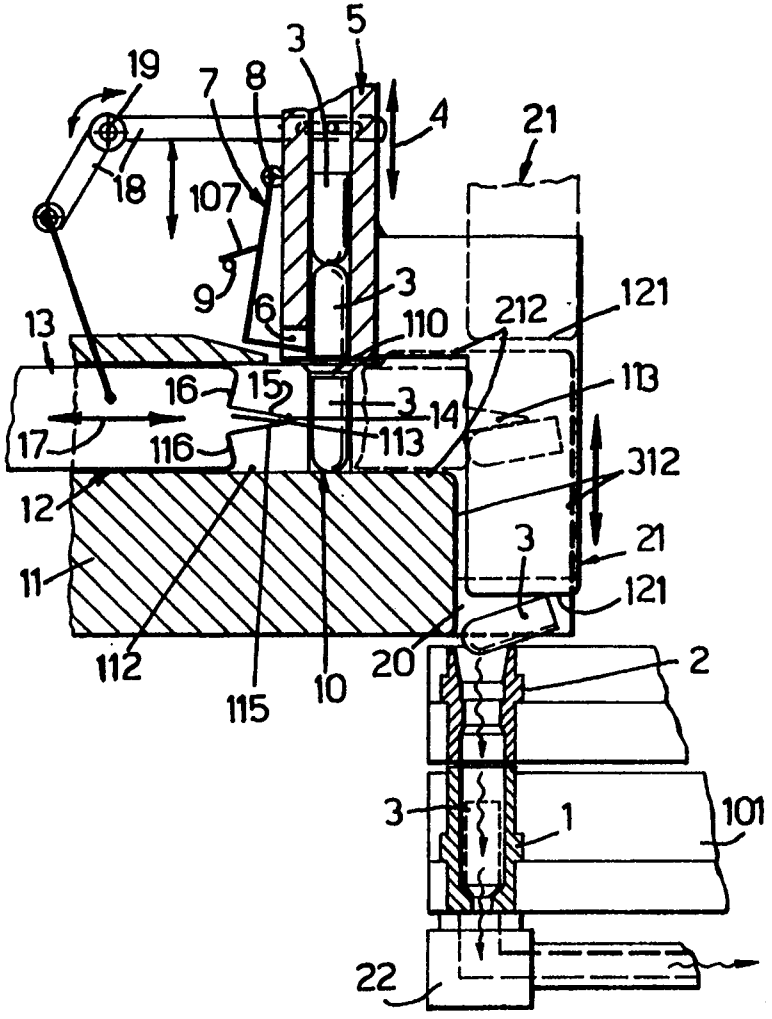
Figure 3:
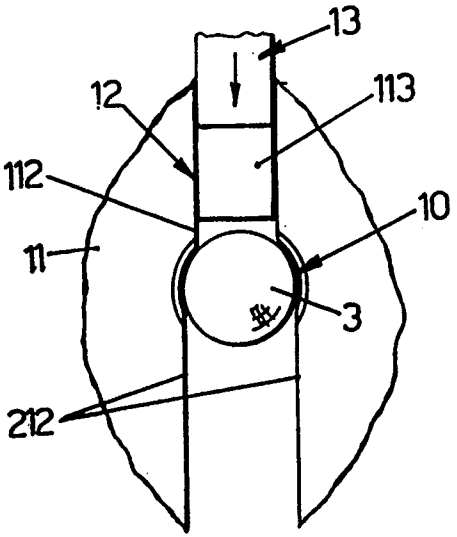
FIG. 3 is a schematic plan view of that part of the device shown in FIGS. 1 and 2, which comprises the first pusher for orientating the bases.

In FIGS. 1, 2, and 3, to which reference will initially be made, 1 and 2 indicate known types of sockets of a carousel-type enclosing machine, with the sockets 1, for containing the base enclosing elements or bases of the capsules, disposed below the sockets 2 for containing the covering enclosing elements or caps of the capsules, at least one of the said sockets, for example the lower socket 1, being supported by known means 101 which, when so commanded, can move it from the condition of axial alignment with the upper socket to a position of non-alignment, usually in order to align the base with a mechanism for introducing a dose of medicinal product into it. The modifications described previously have been made to an enclosing machine of this type.

The device according to the invention for orientating and feeding the bases and caps of the capsules to the sockets 1 and 2 may be disposed in any convenient way to interact with the said sockets of a carousel-type enclosing machine, to provide a high output of the said enclosing machine. The device in question may be fixed and the enclosing machine may be positioned in relation to it with intermittent movements, or it may be mounted on carousels with the axes parallel to those of the enclosing carousel, or it may be mounted on one or more carousels coaxial with the said enclosing carousel, to enable the latter to operate with continuous movement and consequently with a high output. It is therefore to be understood that the relative disposition of the enclosing carousel and the sockets 1–2 and the device for the orientation and separate feeding of the bases and caps of the capsules, as illustrated in the drawings, is provided purely as an example and is not restrictive.

In FIGS. 1 and 2 it will be seen that the bases 3 of the capsules are disposed loosely in a magazine, not illustrated, into the base of which there enters and is moved cyclically with an intermittent axial motion, as indicated by the arrow 4, a tube 5 whose internal diameter is slightly greater than the maximum external diameter of the bases, so that the bases enter the tube in single file, in axial alignment and in random orientation. In the lower part of the tube there is provided a lateral aperture 6 which allows a stop 7, pivoted for example at 8 to the tube, to act on the lower part of the file of bases disposed in the tube, to retain them during the phase in which the tube is raised. The stop 7 is, for example, held in the blocking position by an elastic means which is not illustrated, and is, for example, provided with an extension 107 which, during the phase of lowering of the tube 5, interacts with a projection 9 which opens the stop with the consequent fall of the lowest base 3 from the tube 5 into a vertical seat 10 formed in a body 11, provided with a flared profile 110 at the top, and capable of containing the base with a small amount of play. These means are, for example, similar to those described in Italian patent application No. 29650 A/78 and in the corresponding U.S. Pat. No. 4,427,131, to which broadest reference will be made. In the seat 10, the base 3 stops with its lower end bearing on the flat base of the said seat which is formed with a symmetrical disposition in the intermediate part of a horizontal channel 12, whose base coincides with that of the said seat and whose lateral walls are parallel to each other. The section 112 of channel 12 disposed upline from the seat 10 has a width less than that of the said seat, and a pusher 13 is guided and slides longitudinally in this section, and is provided with a point 113 in the median part of the end facing the said seat 10, the said point being perpendicular to the seat 10, and having a suitably blunted terminal part 14 and having upper and lower surfaces 15 and 115 which are flat and mutually angularly equidistant with respect to the horizontal line passing through the said end 14 of the point. The front surfaces 16 and 116 of the pusher are disposed at 90° with respect to the said surfaces 15 and 115, or are shaped in another suitable way to provide a controlled displacement of the base (see below). The length of the point 113 is, for example, equal to or slightly greater than half the length of the base 3.

The pusher 13 may be activated with a reciprocating movement, as indicated by the arrow 17, by the same means which cyclically raise and lower the tube 5, for example by rods connected to an angled lever 18, pivoted at 19, and which is made to oscillate about the said pivot by suitable means (FIG. 1).

The part 212 of the channel 12 disposed downline from the seat 10 has a width only slightly less than the external width of the base 3 or of any wider area of the base, for example, by an amount of the order of a few hundredths or one or a few tenths of a millimetre, in accordance with the dimensions and/or the characteristics of the bases. The base of the channel section 212 is also aligned with the base of the seat 10 and with the base of the channel section 112.

The channel section 212 communicates with the end of a vertical channel 312 of equal width, facing downwards, also formed in the body 11 and terminating below in a wider section 20.

A flat pusher 21 is fixed to one side of the tube 5, and has a horizontal or suitably inclined lower edge 121 which has to be able to slide in the aforesaid vertical channel section 312, passing from the idle position indicated in FIG. 1 with broken lines, where the said pusher is raised and is outside the channel 212–312, to the lowered position in which the said pusher is engaged in the channel 312 and its lower end 121 enters the wider area 20 of the said channel.

In the phase of feeding a base 3 to a socket 1 of the enclosing machine (see FIGS. 1 and 2), the said socket is axially aligned and close to the upper socket 2 which is empty and is in turn close to the innermost part of the wider end 20 of the descending channel 312, while a pick-up device 22 of a known type, associated with the enclosing machine and connected to a suction source, is disposed under the socket 1.

In the descending movement of the tube 5, a base 3 enters by gravity into the seat 10 in which it may be orientated with the rounded end upwards or downwards, as illustrated in FIGS. 1 and 2 respectively. In the subsequent phase, while the tube 5 is raised to be filled with more bases from the feed magazine and while the stop 7 is closed, the pusher 13 is displaced towards the right in FIGS. 1 and 2, to pass from the position indicated with solid lines to that indicated with broken lines. During this displacement, the end 14 of the point 113 of the pusher acts approximately on the intermediate part of the base 3 disposed in the seat 10 and pushes the base into the channel section 212. As it enters this channel, the base 3 encounters greater friction with its lateral part nearer its closed end, since the other end section nearer the opening is more flexible and deformable because it is open. Consequently, during the displacement by the point 113, the base 3 enters the channel section 212 while rotating about its closed end, so that, regardless of the initial orientation of the base, it enters and slides in the channel 212 while becoming orientated with its open end forwards and becoming disposed under or above the point 113, depending on whether the closed end of the base faces upwards or downwards. The rounded end of the base bears against the front surfaces 16–116 of the pusher which thus displaces the base in the channel 212.

In the subsequent phase of withdrawal of the pusher 13, the base 3 remains, by the effect of friction, in the next area of the channels 212–312 in a substantially horizontal position. During this phase, while the tube 5 descends to feed another base to the seat 10, the pusher 21 descends and with its lower horizontal end 121 pushes downwards the previously orientated base, which enters the wider terminal part 20 of the ascending channel 312 with its closed end above the empty socket 2, through which the effects of the suction exerted by the pick-up device 22 are manifested. The rounded end of the cap is immediately sucked into the socket 2 and the base 3 passes easily through the said socket, which is wider, and is stopped in the lower socket 1 with a vertical disposition and with its open end facing upwards, as illustrated in FIGS. 1 and 2 in broken lines.

The pusher 21 subsequently returns to the high position and the cycle described above is repeated with another pair of empty sockets 1 and 2, while the pair of sockets mentioned previously, with the base 3 in the lower socket, are moved so that they interact, or are caused to interact, with the device for orientating and feeding the caps 23 of the capsules, which will now be described with reference to FIGS. 4, 5 and 6. In these figures it will be seen that the device comprises a magazine (not illustrated) which contains the caps 23 in a loose arrangement and into which there enters from below a vertical tube 25 which is movable in an axially reciprocating way as indicated by the arrow 24 and has an internal diameter such that it holds the caps 23 in single file, in axial alignment and in random orientation. The caps are retained in the tube by a bottom stop device 27, which passes through a lateral opening 26 in the lower part of the said tube and which is withdrawn and opened only at the moment in which the lower end of the tube is brought up to the tapered top 128 of a vertical seat 28, of circular section, whose shape and dimensions are such that they hold a cap 23 in a vertical disposition and in the same orientation as that in which it left the said tube. The seat 28 (see FIG. 6) is formed in a body 111 and is disposed symmetrically in the intermediate part of a horizontal channel 29, whose section 129 has a width less than the diameter of the seat 28 and in which a pusher 31, provided with a point 131 facing the said seat 28, slides and is longitudinally guided with reciprocating displacement as shown by the arrow 30, in phase with the displacement of the tube 25. The end 32 of the point 131 is suitably blunted, while the lower flat surface 33 of the point is substantially horizontal and the upper flat surface 34 is inclined by a few degrees with respect to the subjacent surface. The end surfaces 35 and 36 of the pusher 31 are perpendicular to the aforesaid surfaces 33 and 34 or are otherwise conveniently shaped to provide a controlled displacement of the caps 23 (see below).

The part 229 of the channel 29, disposed downline from the seat 28, has a width slightly less than the external diameter of the cap 23 or of the wider external area of the said cap, as described above for the bases.

Figure 7:
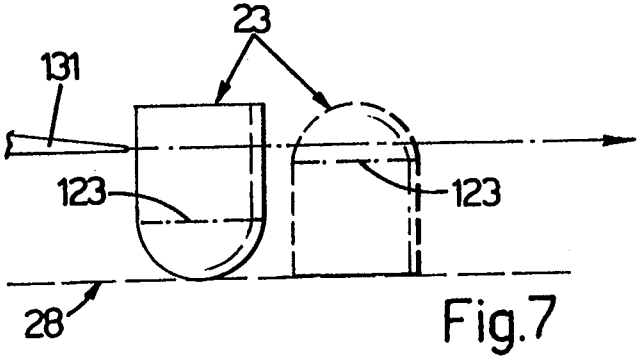
FIG. 7 is a schematic side view of the positioning of the caps with respect to the initial orientation pusher which would occur if the caps were stopped by an end stop with respect to the said pusher.

If the caps 23 were stopped with their lower ends bearing on a flat base of the seat 28, in a similar way to that found in the part of the device for orientating the bases 3, the condition shown in FIG. 7 would be present, with the following set of problems. If the cap 23 entered the seat 28 with its closed end facing downwards, as indicated with the solid line, the cap would be in the optimal position for interaction with the point 131 of the pusher 31 which would be clearly located above the equatorial zone 123 of the rounded end of the said cap. Following the displacement of the point of the pusher towards the right with respect to FIG. 7, the cap 23 would be pushed into the channel section 229 in FIG. 4, where the equatorial zone 123 of its closed and rounded end would encounter the greater resistance, so that the cap would tend to rotate about an axis perpendicular to the opposing areas of greater friction, with consequent orientation of the opening of the cap in the direction of displacement of the pusher.

If, however, the cap 23 entered the seat 28 with its opening facing downwards, as indicated with broken lines in FIG. 7, the equatorial zone 123 of the said cap would be at a short distance from the trajectory of displacement of the point 131 and immediately below the said trajectory, so that in the phase of the operation of the pusher 31 the cap disposed in this way would be crushed or orientated with its opening in a direction opposed to the direction of displacement of the pusher, or would be oriented in a random way.

Figure 9:
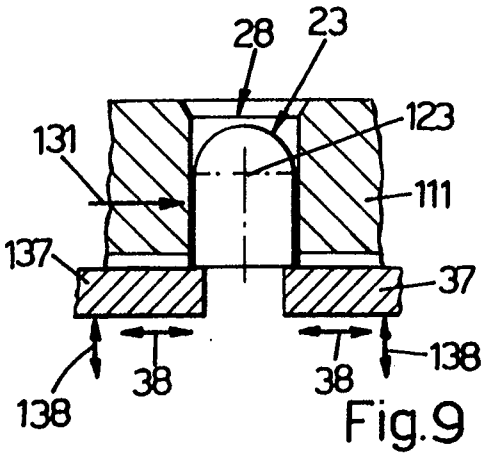
FIGS. 8 and 9 are details of the construction of that part of the device shown in FIG. 6, in section along the line VI—VI and shown in different operating conditions.
Figure 8:
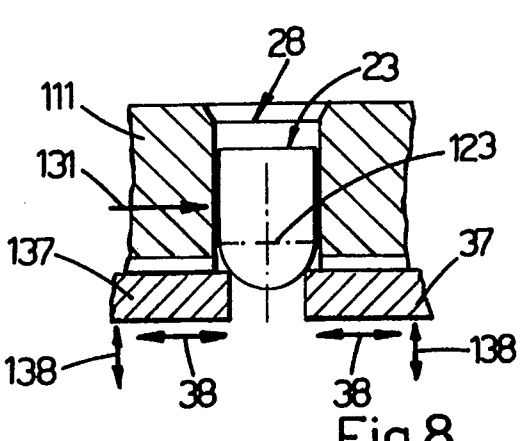

To avoid this problem, it is necessary to ensure that the cap 23 is stopped in the seat 28 in positions at different levels, according to whether it is orientated with its closed end downwards or upwards. In particular, it is necessary to ensure that if the cap enters the seat 28 with its closed end orientated upwards, as indicated by broken lines in FIG. 7, the cap is stopped at a higher level than that at which it is stopped in the opposite orientation, as indicated in FIG. 7 in solid lines. This problem has been solved in an ingenious way, with simplicity and reliability, by providing on the base of the seat 28 at least one or preferably two lateral, opposite and equal supports 37 and 137, which project suitably and by equal amounts into the said seat, are coplanar with each other and meet the following condition: if the cap enters the seat 28 with its closed end facing downwards, as illustrated in FIG. 8, the supports 37 and 137 touch the said end of the cap at points which are as close as possible to the equatorial zone 123 of the said cap. Conversely, if the cap enters the seat 28 with its opening facing downwards, as in FIG. 9, the edge of the said opening is stopped on the supports 37 and 137, providing the desired condition in which the cap is stopped at a level higher than that in which stopping takes place in FIG. 8. In FIGS. 8 and 9, the horizontal arrow 131 indicates schematically the trajectory of displacement of the point of the pusher 31, which in the case of FIG. 8 touches the cap at a point sufficiently far from and higher than the equatorial zone 123 of the said cap, with the consequent downward rotation of the said cap during the displacement in the channel section 229, with its opening orientated forwards and with the point 131 disposed in the lower part as illustrated in FIG. 4 in broken lines. If, however, the cap enters the seat 28 with its opening facing downwards, as in FIG. 9, the point 131 of the pusher 31 touches the cap at a point sufficiently far from and lower than the equatorial zone 123 of the said cap, so that the said cap enters the channel section 229 while rotating upwards, becoming disposed above the said point 131, as illustrated in broken lines in FIG. 5, and becoming orientated with its opening forwards, as in the preceding case.

Figure 6:
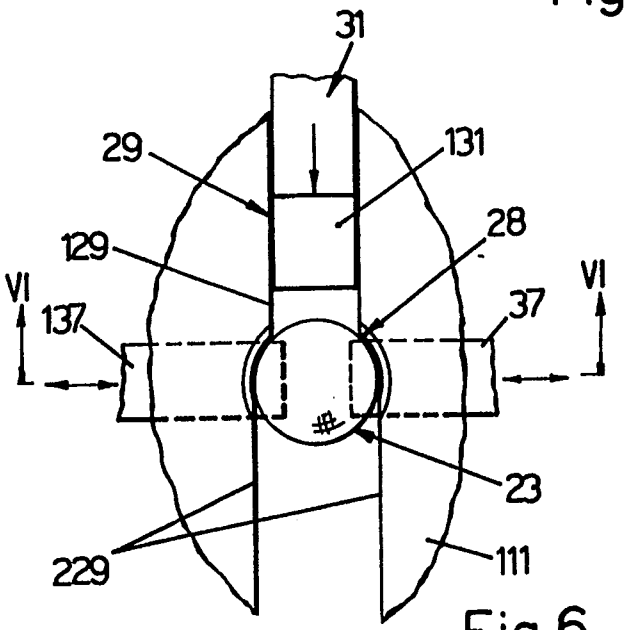
FIG. 6 is a schematic plan view of that part of the device shown in FIGS. 4 and 5, which comprises the first pusher for orientating the caps.

Since the method of manufacturing the enclosing elements of the capsules concerned is such that it does not ensure complete accuracy of the geometry and/or of the dimensions of the said enclosing elements, even among capsules of the same format, the aforesaid supports 37 and 137 may be made adjustable with respect to their projection and/or height within the seat 28, as indicated schematically in FIGS. 6, 8, and 9 by the arrows 38 and 138, to provide maximum reliability and security of operation of the device.

Figure 10:
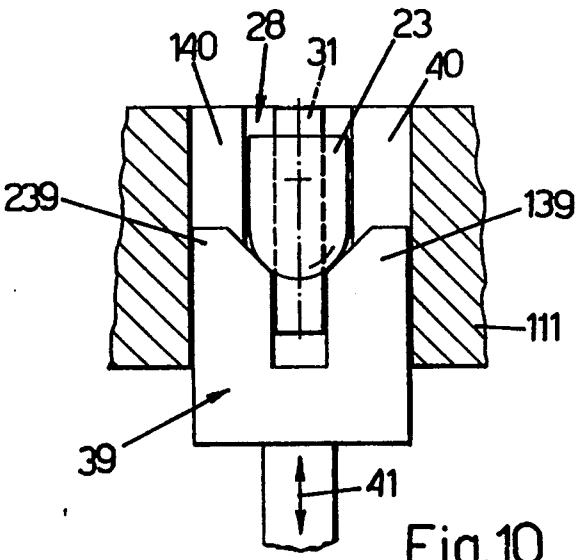
FIG. 10 shows a variant of that part of the device shown in FIG. 6, also shown in section along the line VI—VI.

Equivalent conditions may be obtained with the alternative in FIG. 10, in which the supports 37 and 137 are replaced by the inclined and upwardly diverging ends 139 and 239 of a flat fork 39 which slides and is guided in vertical grooves 40 and 140 formed transversely in the seat 28 and which is connected to means of adjustment shown schematically by the arrows 41, which, when commanded, can raise or lower the said fork, to modify the position of the supports 139 and 239 in the seat 28.

Returning to FIGS. 4 and 5, it will be seen that at the end of the active traversing path of the pusher 31 the cap 23 is located in the area where the horizontal channel section 229 joins a vertical descending channel section 329, of equal width, and having at least a wider terminal section 42. The descending channel 329 may preferably be provided with a band 43 close to the outer longitudinal edge, and having the same width as the aforesaid terminal section 42. When the cap 23 enters the initial upper part of the channel 329, the band 43 is engaged exclusively over a small section with the opening of the said cap.

Figure 5:
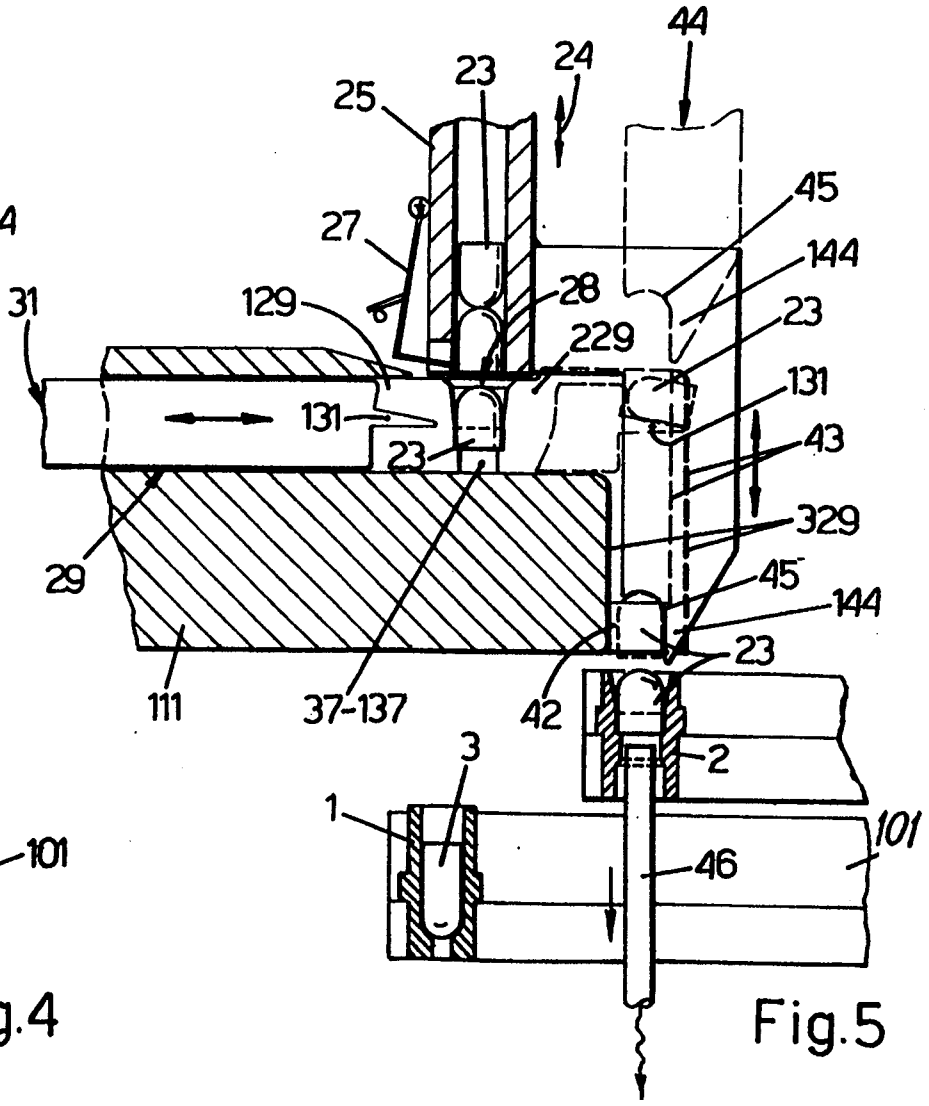
FIGS. 4 and 5 are side views and partial sections of the components of the device for orientating and feeding the caps of the capsules, shown in different operating conditions in each figure.
Figure 4:
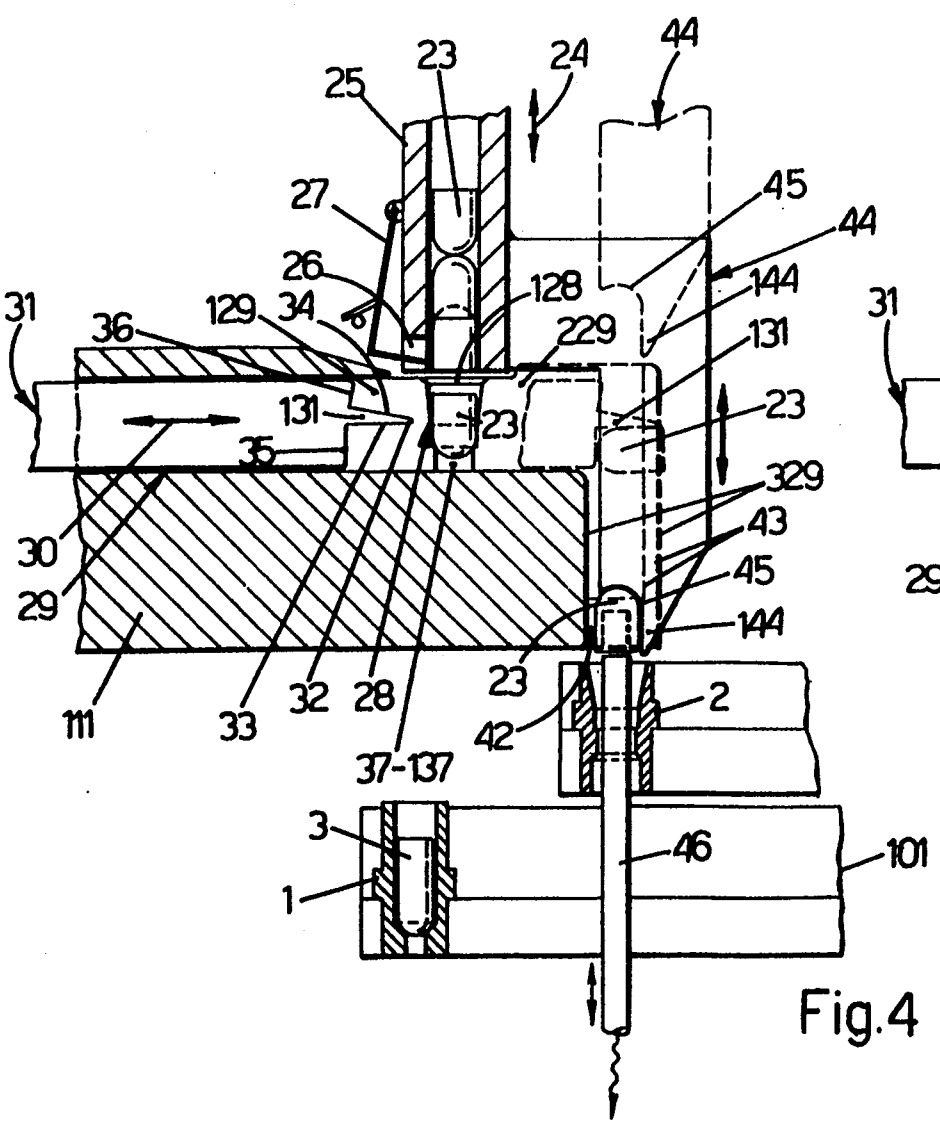

From FIGS. 4 and 5 it will be seen that a flat pusher 44 is made integral with the tube 25, faces downwards, and has a pointed lower end 144 whose side facing the inner side of the channel 329 partially reproduces the profile of a cap 23 with a vertical disposition, as indicated by seat 45. When the tube 25 is in the position of maximum elevation, the pusher 44 is above and outside the channel 329, as illustrated in broken lines in FIGS. 4 and 5. Conversely, when the tube 25 is lowered, the pusher 44 is inside the channel 329 and its point enters the wider area 42, as illustrated in solid lines in FIGS. 4 and 5.

The socket 2 of the enclosing machine is brought below and close to the channel 329, in alignment with the said channel, as illustrated in FIGS. 4 and 5, while the socket 1 with the base 3 has been previously brought out of alignment and conveniently removed from the socket above it, so that an axially hollow rod 46 connected to a suction circuit may be inserted axially from below into the said socket 2, with its upper end entering the wider terminal part 42 of the said channel 329.

When the tube 25 is lowered to feed another cap 23 into the seat 28 and the pusher 31 withdraws, leaving a cap orientated with its opening forwards in the area in which the channels 229 and 239 join, the pusher 44 is lowered, and its point 144 comes into interaction with a point on the cap lying between its opening and the equatorial zone, at an exact distance from the latter, and, as a result of the friction which the said equatorial zone encounters in the channel 329, the said cap is rotated with its opening downwards, engages the shaped seat 45 of the pusher 44 and is displaced downwards by the latter, remaining in a vertical position and with its opening orientated downwards, until it enters the wider area 42, where the cap falls by gravity over the upper end of the tube 46 on which it is held securely by the suction effect provided by the said tube. In a subsequent phase, as illustrated in FIG. 5, while the pusher 44 rises again to repeat the cycle described, the tube 46 descends and inserts the cap 23 into the socket 2 which retains the said cap because of its known shape, while the tube returns to the lower idle position.

Figure 11:
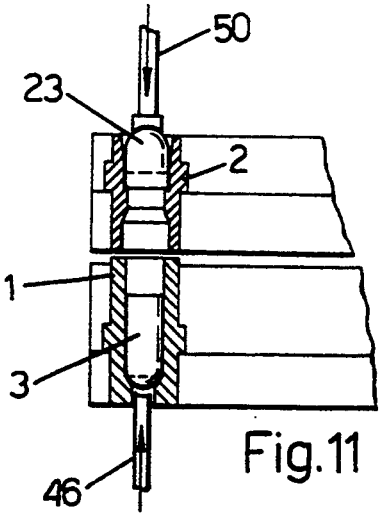
FIGS. 11, 12, and 13 are side views and partial sections of the sockets which contain the bases and caps of the capsules during the known phases of joining of these two components and of expulsion of the sealed capsule.
Figure 12:
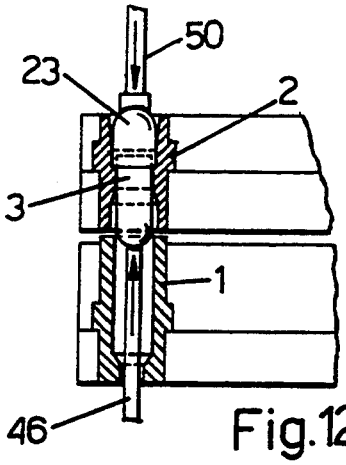
Figure 13:
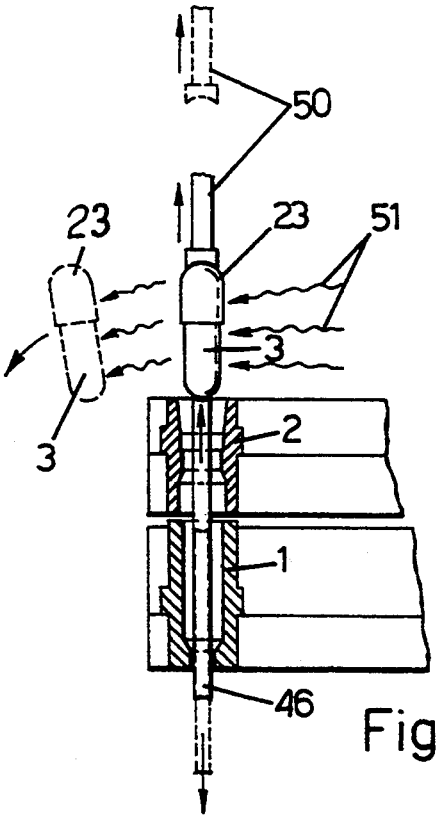
Figure 14:
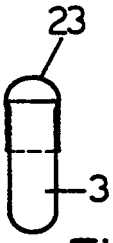
FIGS. 14, 15, 16, and 17 are longitudinal sections through a sealed capsule in certain possible conditions in which it may leave the system to which the base and cap of the capsule are fed independently of each other and in the correct orientation.
Figure 15:
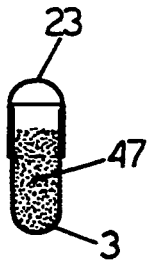
Figure 16:
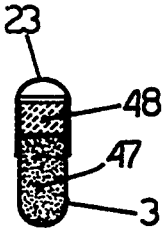
Figure 17:
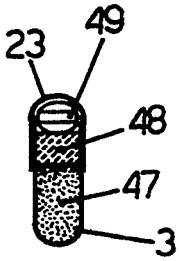

While the socket 1 is in the non-aligned position illustrated in FIGS. 4 and 5, it is possible to insert into the base 3, disposed in the said socket, no product at all, as illustrated in FIG. 14, or one or more doses of medicinal product 47 in succession as in FIG. 15, or the said doses of product 47 and a plug 48 as in FIG. 16, or the doses of product 47, the plug 48 and a further dose of product 49 as in FIG. 17. In a subsequent and final phase of operation of the enclosing machine, the lower socket 1 with the cap 3 is re-aligned with the upper socket 2 with the cap 23 and, as illustrated in FIG. 11, a check piece 50 is positioned on the cap to prevent its axial displacement, while a rod 46 is inserted in the lower socket and raises the base 3, inserting its upper end into the cap 23 and pre-sealing or sealing the capsule, as illustrated in FIG. 12 and in the various suggested forms shown in FIGS. 14, 15, 16, and 17. The rod 46 then continues to rise, as shown in FIG. 13, with an equal displacement or removal of the check piece 50, to extract the sealed capsule from the sockets 1 and 2 and subsequently to expel the said capsule towards collecting means disposed outside the enclosing machine, with the additional aid of an air jet schematically indicated by the arrows 51.

We claim:

1. A device for cyclically orienting bases and caps and then for forming hard gelatin capsules therefrom holding a medicinal product where the bases and caps are disposed loose in respective magazines and where the bases and caps have a rounded end and an open end, said device comprising:

a base orienting portion including a base pick-up means for picking up bases from the base magazine and for cyclically releasing a base;

a first base horizontal channel having a) a base up-line section having a width less than that of said base seat, b) a base down-line section having a width slightly less than a width of a widest external area of the base, and c) a base intermediate section intermediate said base up-line section and said base down-line section in which a base vertical seat is provided into which said base vertical seat the bases are released by said base pick-up means with a vertical disposition and random orientation, d) a base terminal part at a base down-line end of said base horizontal channel;

a first base pusher having a) a first base point facing said base seat such that said first base point engages an intermediate part of the base held in said base seat, and b) a first base front end from which said first base point extends;

a first base moving means for cyclically moving said first base pusher to slide longitudinally in said first base horizontal channel (a) from an idle position up-line of said base seat, (b) to a position where said first base point engages the intermediate part of the base and pushes the base into said base down-line section where the base slides with greater friction in an area close to the rounded end thereof which offers greater resistance to crushing so that under movement from said first base pusher the base is oriented with the opening forward and to one vertical side of said first base point and with the rounded end engaged with said first base front end, (c) to said base terminal part with the opening of the base forwards and with a substantial horizontal orientation, and (d) back to the idle position whereby another base is cyclically released into said base seat;

a base vertical channel oriented downwards and located at the base terminal end of said first base horizontal channel, said base vertical channel having a base initial width which is the same as that of said first base horizontal channel and a base lower terminal section which is wider than the base initial width, a base supporting socket located beneath said base lower terminal section, a base suction means for exerting a suction on said base supporting socket, a second base pusher having a base flat horizontal end, and a second base moving means for moving said second base pusher cyclically (a) from an idle position above said base terminal end of said first base horizontal channel (b) to engagement of the base flat horizontal end with the base moved into said base terminal end of said first base horizontal channel by said first base pusher element so that the base descends horizontally and enters said base lower terminal section whereby said base suction means draws the closed end of the base into the base supporting socket with the base opening upwards so that the medicinal product is subsequently easily introduced into the base, and (c) back to the idle position whereby another base is cyclically moved into said base terminal end;

a cap orienting portion including a cap pick-up means for picking up caps from the cap magazine and for cyclically releasing a cap;

a first cap horizontal channel having a) a cap up-line section having a width less than that of said cap seat, b) a cap down-line section having a width slightly less than a width of a widest external area of the cap, and c) a cap intermediate section intermediate said cap up-line section and said cap down-line section in which a cap vertical seat is provided into which said cap vertical seat the caps are released by said cap pick-up means with a vertical disposition and random orientation, d) a cap terminal part at a cap down-line end of said cap horizontal channel;

a first cap pusher having a) a first cap point facing said cap seat such that said first cap point engages an intermediate part of the cap held in said cap seat, and b) a first cap front end from which said first cap point extends;

a first cap moving means for cyclically moving said first cap pusher to slide longitudinally in said first cap horizontal channel (a) from an idle position up-line of said cap seat, (b) to a position where said first cap point engages the intermediate part of the cap and pushes the cap into said cap down-line section where the cap slides with greater friction in an area close to the rounded end thereof which offers greater resistance to crushing so that under movement from said first cap pusher the cap is oriented with the opening forward and to one vertical side of said first cap point and with the rounded end engaged with said first cap front end, (c) to said cap terminal part with the opening of the cap forwards and with a substantial horizontal orientation, and (d) back to the idle position whereby another cap is cyclically released into said cap seat;

a cap vertical channel oriented downwards and located at the cap terminal end of said first cap horizontal channel, said cap vertical channel having a cap initial width which is the same as that of said first cap horizontal channel and a cap lower terminal section which is wider than the cap initial width, a cap supporting socket located beneath said cap lower terminal section, a hollow rod which is connected to a cap suction means for exerting a suction on an upper end of said hollow rod, a second cap pusher having a cap shaped portion and a cap pointed end extending therefrom, and a second cap moving means for moving said second cap pusher cyclically (a) from an idle position above said cap terminal end of said first cap horizontal channel (b) to engagement of the cap pointed end with the intermediate part of the cap moved into said cap terminal end of said first cap horizontal channel by said first cap pusher element so that the cap rotates and descends with the opening thereof downwardly directed and the cap laterally adjacent said cap pointed end and engaged by said cap shaped portion whereby the cap enters said cap lower terminal section and (c) back to the idle position whereby another cap is cyclically moved into said cap terminal end, and a rod moving means for cyclically moving said upper end of said hollow rod (a) axially upwards through said cap supporting socket into engagement with the cap moved by said second cap pusher into said cap lower terminal section and (b) downwards with the cap held thereto to an idle position whereby the cap is deposited in said cap supporting socket with a vertical disposition and with the opening thereof facing downwards; and a capsule forming portion including an aligning means for aligning said base supporting socket with the base therein vertically below said cap supporting socket, a forming pusher which engages the rounded end of the base in said base supporting socket, a check piece which engages the rounded end of the cap in said cap supporting socket, and a moving means for moving the check piece into engagement with the rounded end of the cap in said cap supporting socket and for moving the forming pusher upwards to raise the base into joining engagement with the cap held in place thereabove by said check piece to form a sealed capsule, and for raising said check piece and forming pusher together to remove the capsule from said cap supporting socket for collection thereof.

2. A device for orienting as claimed in claim 1:

wherein the width of the base down-line section and the base initial width of the base vertical channel is selected from one of a few hundredths, one tenth millimeter, or a few tenths of a millimeter less than the widest external area of the bases; and wherein the width of the cap down-line section and the cap initial width of the cap vertical channel is selected from one of a few hundredths, one tenth millimeter, or a few tenths of a millimeter less than the widest external area of the caps.

3. A device for orienting as claimed in claim 1 wherein:

said base pick-up means includes a base vertical tube located movably above said base vertical seat and having (a) a base upper end located in the bottom of the base magazine so that the bases are disposed in said base vertical tube in single file, in axial alignment, and in coaxial orientation, (b) a base lower end located opposite said base upper end, and (c) a stop device adjacent said base lower end which moves reciprocally to allow one base to drop at a time when said base vertical tube is lowered adjacent said base vertical seat, and a base tube moving means (a) for raising and lowering said base vertical tube, (b) for causing the cyclical movements of said first base pusher such that said first base pusher is adjacent said base terminal part when said base vertical tube is raised, and (c) for causing the cyclical movements of said second base pusher such that said second base pusher is adjacent said base lower terminal section when said base vertical tube is lowered; and said cap pick-up means includes a cap vertical tube located movably above said cap vertical seat and having (a) a cap upper end located in the bottom of the cap magazine so that the caps are disposed in said cap vertical tube in single file, in axial alignment, and in coaxial orientation, (b) a cap lower end located opposite said cap upper end, and (c) a stop device adjacent said cap lower end which moves reciprocally to allow one cap to drop at a time when said cap vertical tube is lowered adjacent said cap vertical seat, and a cap tube moving means (a) for raising and lowering said cap vertical tube, (b) for causing the cyclical movements of said first cap pusher such that said first cap pusher is adjacent said cap terminal part when said cap vertical tube is raised, and (c) for causing the cyclical movements of said second cap pusher such that said second cap pusher is adjacent said cap lower terminal section when said cap vertical tube is lowered.

4. A device for orienting as claimed in claim 1 wherein said first base point of said first base pusher has:

a length equal to or greater than half of a length of the base, a vertical cross section of an isosceles triangle with upper and lower surfaces, and the upper and lower surfaces are perpendicular to end surfaces of said first base front end.

5. A device for orienting as claimed in claim 1 wherein said base orienting portion includes a cap supporting socket moving means for moving said cap supporting socket between said base lower terminal section and said base supporting socket whereby said cap supporting socket guides the base from said base lower terminal section into said base supporting socket when said second base moving means moves said second base pusher and the associated base to said base lower terminal section and the base is drawn into said base supporting socket by said base suction means.

6. A device for orienting as claimed in claim 1 wherein said first cap point of said first cap pusher has:

a length equal to or greater than half of a length of the cap, a vertical cross section of a right-angle triangle with an upper oblique surface facing upwards and a lower surface which is horizontal, and the upper and lower surfaces are perpendicular to end surfaces of said first cap front end.

7. A device for orienting as claimed in claim 1 wherein said cap vertical seat includes internal and opposing cap supports, said supports (a) supporting the cap in a zone close to an equatorial zone of the rounded end when the rounded end is oriented downwards, and (b) supporting the cap at an edge of the open end when the open end is oriented downwards such that the cap is positioned at a higher position than when the rounded end is downwards and supported by the cap supports whereby the equatorial zone of the rounded end is higher than said first cap point of said first cap pusher.

8. A device for orienting as claimed in claim 7:

wherein said opposing cap supports are disposed at a bottom of said cap vertical seat; and further including cap support moving means for moving said opposing cap supports to vertically change positions at which the caps are vertically supported to accommodate variations of the caps.

9. A device for orienting as claimed in claim 8:

wherein said cap supports are upper and upwardly diverging ends of a fork;

wherein said cap vertical seat includes a groove formed transversely therein; and wherein said cap supporting means moves said fork vertically in said groove.

10. A device for orienting as claimed in claim 1 wherein said cap vertical channel includes a longitudinal external band at a side remote from said first cap horizontal channel having a width substantially equal to that of said cap lower terminal section such that friction with the open end of the cap therein is reduced during movement of said cap by said second cap pusher to favor rotation of the cap with the open end facing downwards.

11. A device for orienting as claimed in claim 1 wherein said cap shaped portion of said cap second pusher is rounded.

12. A device for orienting as claimed in claim 1 and further including a carousel-type enclosing machine to which said base supporting socket and said cap supporting socket are operatively connected.

13. A device for orienting as claimed in claim 1 wherein said capsule forming means further includes an air jet means for blowing the formed capsule from between said check piece and said forming pusher for collection thereof.

* * * * *